US012644620B1

(12) United States Patent
Seliger

(10) Patent No.: US 12,644,620 B1
(45) Date of Patent: Jun. 2, 2026

(54) AUTOMATED SMART BUILDING PEAK LOAD MANAGEMENT

(71) Applicant: Arctevity Inc., Woburn, MA (US)

(72) Inventor: Robert Seliger, Beverly, MA (US)

(73) Assignee: Arctevity Inc., Woburn, MA (US)

( * ) Notice: Subject to any disclaimer, the term of this patent is extended or adjusted under 35 U.S.C. 154(b) by 615 days.

(21) Appl. No.: 17/970,835

(22) Filed: Oct. 21, 2022

Related U.S. Application Data

(60) Provisional application No. 63/275,570, filed on Nov. 4, 2021.

(51) Int. Cl.
*F24F 11/63* (2018.01)
*F24F 11/54* (2018.01)

(52) U.S. Cl.
CPC ..... *F24F 11/63* (2018.01); *F24F 11/54* (2018.01)

(58) Field of Classification Search
CPC ..... F24F 11/63; F24F 11/54
See application file for complete search history.

(56) References Cited

U.S. PATENT DOCUMENTS 7,809,472 B1 * 10/2010 Silva ..... F24F 11/62 236/1 C
2003/0023724 A1 * 1/2003 Martin ..... H04L 9/40 709/225
2005/0097905 A1 * 5/2005 Kwon ..... F24F 11/52 62/157
2015/0167997 A1 * 6/2015 Saffre ..... F24F 11/64 700/276
2016/0146494 A1 * 5/2016 Rajan ..... F24F 11/66 700/276
2016/0187908 A1 * 6/2016 Cai ..... F24F 11/62 700/276
2017/0198932 A1 * 7/2017 Sato ..... F24F 11/30
2024/0247832 A1 * 7/2024 Shinmoto ..... F24F 11/54

* cited by examiner

*Primary Examiner* — Mohammad Ali
*Assistant Examiner* — Vincent W Chang
(74) *Attorney, Agent, or Firm* — Cesari and McKenna, LLP

(57) ABSTRACT

Embodiments generally relate to reducing peak load consumption of energy. In some embodiments, a method includes receiving a plurality of requests for energy consumption by a corresponding plurality of climate control appliances in a predetermined environment. The method further includes determining an energy consumption level for each request of the plurality of requests for a time period. The method further includes determining a schedule for granting the plurality of requests during the time period, where a difference between a highest aggregate energy consumption level and a lowest aggregate energy consumption level during the time period is minimized.

19 Claims, 8 Drawing Sheets

500

100

200

AUTOMATED SMART BUILDING PEAK LOAD MANAGEMENT

CROSS-REFERENCE TO RELATED APPLICATIONS

The present application claims priority to U.S. Provisional Patent Application Ser. No. 63/275,570, entitled "Autonomous Buildings" and filed Nov. 4, 2021. The foregoing application is incorporated herein by reference in its entirety.

BACKGROUND OF THE INVENTION

Electrical utility bills generally include a fee for the peak demand as determined over the course of a billing period. In some locations, peak demand is determined as the four consecutive periods, measured in fifteen-minute intervals, during which electrical demand for the month was the greatest. This measurement affects the distribution demand charge portion of a client's bill, which can range from 5-30% of the overall bill. This charge may also be applied to the kVA output of customer-owned interconnected electrical generation. In some locations, there may be no fixed times during which the peak demand sampling occurs (e.g., it's not always on the hour). This means that one cannot rely on a "special time" during the day to reduce the peak demand.

BRIEF SUMMARY OF THE INVENTION

Disclosed herein is a method for reducing peak load consumption of energy and a corresponding system and a computer program product as specified in the independent claims. Embodiments of the present invention are given in the dependent claims. Embodiments of the present invention can be freely combined with each other if they are not mutually exclusive.

In some scenarios, where there are a few high electrical demand equipment, it can be hard to minimize peak electrical utilization. For example, in a building with a single air conditioning compressor, the only choice the building owner has is to set the target temperature high enough to maintain some level of comfort without causing the compressor to run excessively.

In a building with a large quantity of equipment, better options are available. This is particularly true in multi-dwelling buildings where the trend continues to be to decentralize heating equipment (e.g., heat pumps, boilers, etc.) and cooling equipment (e.g., air conditions, chillers, etc.). For example, for heating, individual apartments are outfitted with a heat pump for each heating zone. A single bedroom apartment might have one or two zones, while a two-bedroom apartment might have two or three zones. As described in more details herein, when this is the case, peak electrical demand may be reduced by the use of a coordination algorithm that ensures that only some, but not all, of the heat pumps are running at the same time even if room temperature targets would otherwise dictate the activation of a heat pump for heating or cooling.

According to one embodiment of the present invention, a method includes receiving a plurality of requests for energy consumption by a corresponding plurality of climate control appliances in a predetermined environment. The method further includes determining an energy consumption level for each request of the plurality of requests for a time period. The method further includes determining a schedule for granting the plurality of requests during the time period, where a difference between a highest aggregate energy consumption level and a lowest aggregate energy consumption level during the time period is minimized.

In another embodiment, each request of the plurality of requests is a request to operate a corresponding climate control appliance of the plurality of climate control appliances. In another aspect, the climate control appliances include one or more of heating, ventilation, and air conditioning (HVAC) appliances. In another aspect, the energy consumption level for each request is based on a type of climate control appliance that is associated with each request. In another aspect, the schedule for granting the plurality of requests is based on one or more duty cycle policies, where the one or more duty cycle policies restricts a portion of the plurality of climate control appliances that operate substantially simultaneously during the time period. In another aspect, the schedule for granting the plurality of requests is based on one or more duty cycle policies, where at least one of the duty cycle policies limits a number of the plurality of climate control appliances that are permitted to operate during the time period to one climate control appliance. In another aspect, the method further includes issuing an activation ticket for each request that is granted, where each activation ticket includes a start time and an expiration time that a corresponding climate control appliance is permitted to operate.

DETAILED DESCRIPTION OF THE INVENTION

Figure 1:
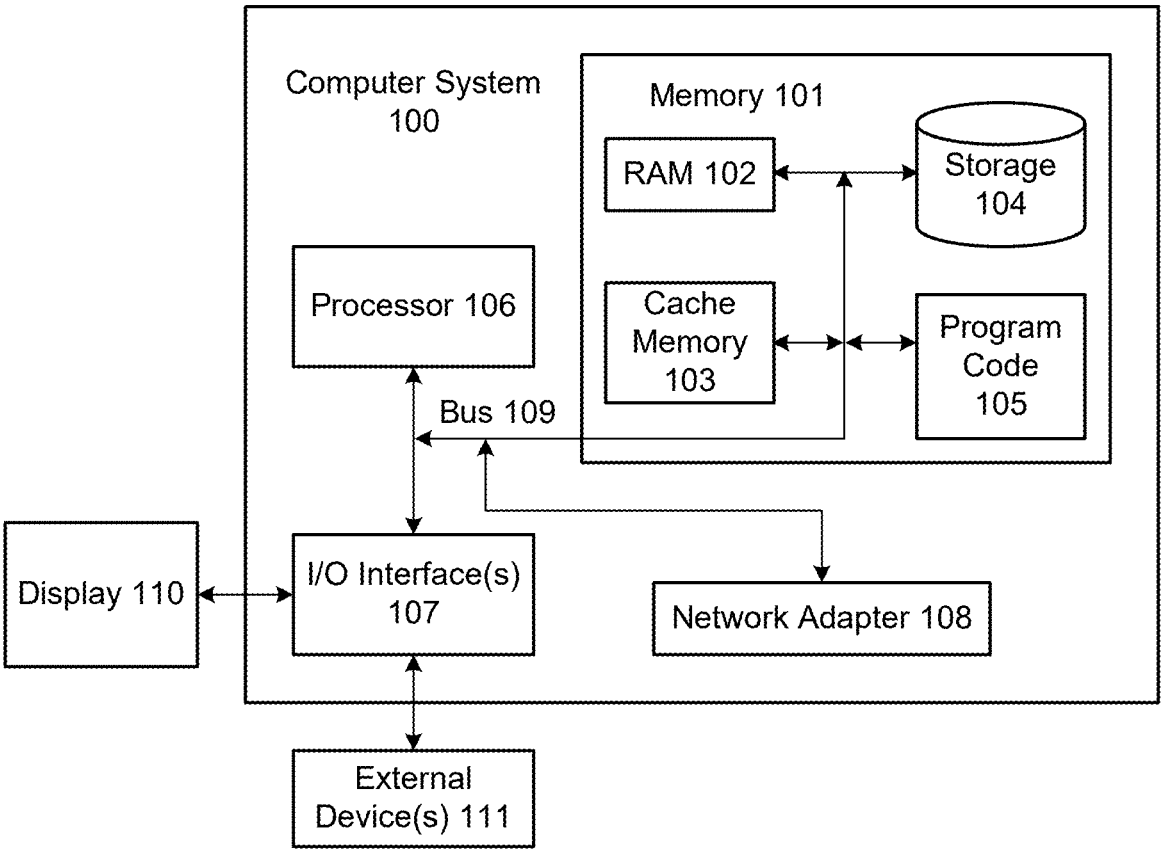
FIG. 1 illustrates an example computer system used for reducing peak load consumption of energy, according to embodiments of the present invention.

The present invention reduces peak load consumption of energy. The following description is presented to enable one of ordinary skill in the art to make and use the present invention and is provided in the context of a patent application and its requirements. Various modifications to the embodiment will be readily apparent to those skilled in the art and the generic principles herein may be applied to other embodiments. Thus, the present invention is not intended to be limited to the embodiment shown but is to be accorded the widest scope consistent with the principles and features described herein.

As described in more detail herein, embodiments provide autonomous control of climate control appliances in environments such as residential and commercial buildings. Embodiments activate and deactivate climate control appliances such as heat pumps and air conditioner appliances in a manner that reduces and minimizes aggregate energy consumption while supplying sufficient climate comfort to end users in climate-controlled environments.

As described in more detail herein, a system receives a plurality of requests for energy consumption by a corresponding plurality of energy consuming device in a predetermined environment such as a house, a commercial building, or a collection of buildings. The energy consuming devices may include any equipment that consumes energy, such as heating and cooling appliances, manufacturing equipment, hospital equipment, and other types of equipment or appliances that consume energy in the predetermined environment. The system further determines an energy consumption level for each request of the plurality of requests for a time period. The system further determines a schedule for granting the plurality of requests during the time period, where a difference between a highest aggregate energy consumption level and a lowest aggregate energy consumption level during the time period is minimized.

Reference in this specification to "one embodiment", "an embodiment", "an exemplary embodiment", "some embodiments", or "a preferred embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments. In general, features described in one embodiment might be suitable for use in other embodiments as would be apparent to those skilled in the art.

It should be understood that the exemplary embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from their spirit and scope.

All components of the device and their locations, electronic communication methods between the system components, magnet types, cables, wiring, attachment or securement mechanisms, mechanical connections, electrical connections, dimensions, values, materials, charging methods, battery types, applications/uses, tools and devices that can be used therewith, etc. discussed above or shown in the drawing, if any, are merely by way of example and are not considered limiting and other component(s) and their locations, electronic communication methods, magnet types, cables, wiring, attachment or securement mechanisms, mechanical connections, electrical connections, dimensions, values, materials, charging methods, battery types, applications/uses, tools and devices that can be used therewith, etc. can be chosen and used and all are considered within the scope of the disclosure.

The present invention can take the form of an entirely hardware embodiment, an entirely software embodiment or an embodiment containing both hardware and software elements. In a preferred embodiment, the present invention is implemented in software, which includes but is not limited to firmware, resident software, microcode, etc.

Furthermore, the present invention can include a computer readable storage medium providing program code for use by or in connection with a computer or any instruction execution system. For the purposes of this description, a computer usable or computer readable storage medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, point devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified local function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

FIG. 1 illustrates an example computer system 100 used for reducing peak load consumption of energy, according to embodiments of the present invention. The computer system 100 is operationally coupled to a processor or processing units 106, a memory 101, and a bus 109 that couples various system components, including the memory 101 to the processor 106. The bus 109 represents one or more of any of several types of bus structure, including a memory bus or memory controller, a peripheral bus, an accelerated graphics port, and a processor or local bus using any of a variety of bus architectures. The memory 101 may include computer readable media in the form of volatile memory, such as random-access memory (RAM) 102 or cache memory 103, and a storage unit 104, which may include non-volatile storage media or other types of memory. The memory 101 may include at least one program product having a set of at least one program code module 105 that are configured to carry out the functions of embodiment of the present invention when executed by the processor 106. The computer system 100 may also communicate with one or more external devices 111, such as a display 110, via I/O interfaces 107. The computer system 100 may communicate with one or more networks via a network adapter 108. In other implementations, the computer system 100 may not have all of the components shown and/or may have other elements including other types of elements instead of, or in addition to, those shown herein.

Figure 2:
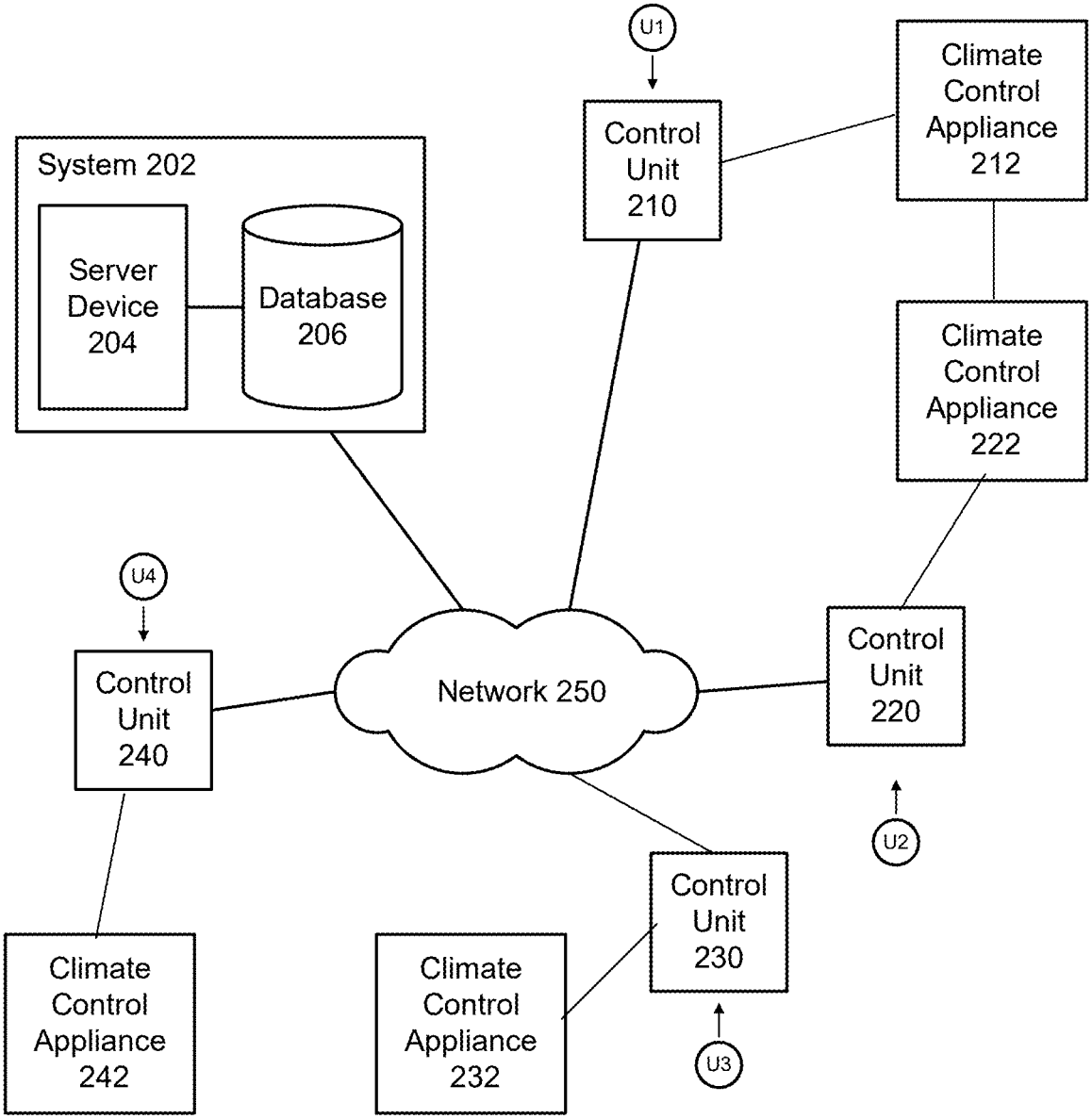
FIG. 2 is a block diagram of an example network environment for reducing peak load consumption of energy, which may be used for some implementations described herein.

FIG. 2 is a block diagram of an example network environment 200 for reducing peak load consumption of energy, which may be used for some implementations described herein. In some implementations, the network environment 200 includes a system 202, which includes a server device 204 and a database 206. The network environment 200 also includes a control unit 210 that controls a climate control appliance 212, a control unit 220 that controls a climate control appliance 222, and a control unit 230 that controls a climate control appliance 232, a control unit 240 that controls a climate control appliance 242. Users U1, U2, U3, U4 may program the control units 210, 220, 230, and 240 to operate the climate control appliances 212, 222, 232, and 242.

In various embodiments, the control units 210, 220, 230, and 240 may have user interfaces for receiving inputs and/or programming commands from users. These control units may also be coupled to various climate control measuring sensors such as thermometers, barometers, etc. or a combination of these and other sensors. The control units 210, 220, 230, and 240 communicate with the system 202 to send requests and receive activation tickets for operating their corresponding climate control appliances. The network environment 200 also includes a network 250 through which the system 202 and the control units 210, 220, 230, and 240 communicate. The network 250 may be any suitable communication network such as a Wi-Fi network, Bluetooth network, the Internet, etc.

In various embodiments, the environment 200 may be, for example, a house, office building, a collection of buildings, etc. The environment 200 may represent other environments such as a manufacturing floor, etc., and will depend on the particular embodiment.

For ease of illustration, FIG. 2 shows one block for each of the system 202, the server device 204, and the network database 206, and shows four blocks for the control units 210, 220, 230, and 240. Blocks 202, 204, and 206 may represent multiple systems, server devices, and network databases. Also, there may be any number of control units and corresponding climate control appliances.

While various embodiments are described herein in the context of the stated types of high energy demand appliances, these embodiments may also apply to other types of energy consuming devices. In other implementations, the environment 200 may not have all of the components shown and/or may have other elements including other types of elements instead of, or in addition to, those shown herein.

While the system 202 performs embodiments described herein, in other embodiments, any suitable component or combination of components associated with the system 202 or any suitable processor or processors associated with the system 202 may facilitate performing the embodiments described herein.

Figure 3:
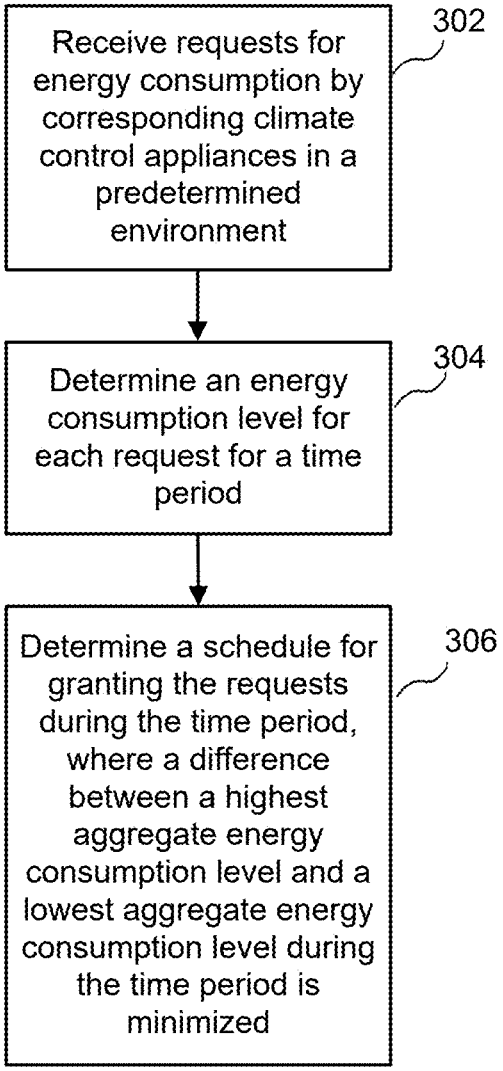
FIG. 3 is an example flow diagram for reducing peak load consumption of energy, according to some embodiments.

FIG. 3 is an example flow diagram for reducing peak load consumption of energy, according to some embodiments. Referring to both FIGS. 2 and 3, a method begins at block 302, where a system such as the system 202 receives requests for energy consumption by corresponding climate control appliances in a predetermined environment, such as the environment 200. In various embodiments, each request is a request for energy consumption in that each request is a request to operate or turn on a corresponding climate control appliance, which consumes energy. The climate control appliances 212, 222, 232, and 242 may include various types of appliances. For example, in various embodiments, the climate control appliances 212, 222, 232, and 242 may include one or more of heating, ventilation, and air conditioning (HVAC) appliances. Implementations described herein reduce and minimize energy consumption of these climate control appliances.

In some implementations, a given request may be generated based on user input to a control unit for a given climate control appliance. For example, a control unit may receive user input to turn on a given climate control device such as an air conditioner. Instead of immediately turning on the air conditioner, the control unit generates and sends a request to the system.

In some implementations, a given request may also be generated based on programmed settings of a control unit for a given climate control appliance. The programmed settings may include a schedule, a temperature setting, etc. For example, a control unit may receive input to turn on a given climate control device such as an air conditioner when the temperature goes above 80 degrees Fahrenheit. If the air conditioner reaches 81 degrees Fahrenheit, instead of immediately turning on the air conditioner, the control unit generates and sends a request to the system.

In various implementations, the predetermined environment may be any predetermined space within an enclosed environment. The predetermined environment may be a home, an office building, or portions thereof. The particular spaces may vary and will depend on the particular implementation. For example, in a home environment, the space may include particular levels of a house, a living or family room, a kitchen, bedrooms, an office, bathrooms, etc., or a combination thereof. In an office building environment, the space may include particular floors of the building, a factory floor, meeting or conference rooms, a reception area, a kitchen, offices, restrooms, etc., or a combination thereof. In an industrial building environment, the space may include a factory floor, offices, restrooms, etc., or a combination thereof. The predetermined environment may be a single building or a collection of buildings.

At block 304, the system determines an energy consumption level for each request for a time period. As indicated above, the climate control appliances may include one or more of heating, ventilation, and air conditioning (HVAC) appliances. In various embodiments, the energy consumption level for each request is based on a type of climate control appliance that is associated with each request.

In some implementations, the system may determine different types or classes of climate control appliances that are connected to the system and which control the climate of the environment. The different types of climate control appliances consume different amounts of power, and the system determines how much each climate control appliance consumes (e.g., energy units per hour). In some implementations, the energy consumption level per time period (e.g., per hour, etc.) may be predetermined. In various embodiments, the time period may include larger intervals of time (e.g., day, week, month, etc.) for which an average of peak energy consumption is measured, which may depend on the particular utility companies for particular regions.

In some implementations, the energy consumption of a given climate control appliance may be programmed into the system by a user such as a technician. In some implementations, the system may automatically (without user intervention) look up the energy consumption of a given climate control appliance online based on the make and model of the given climate control appliance. In some implementations, the system may automatically (without user intervention) measure the energy consumption of a given climate control appliance, and monitor and log energy usage when the climate control appliance is in operation. This implementation may be useful for monitoring energy usage of some appliances that consume a significantly large amount of power and/or that may be older, less energy efficient models.

Some climate control appliances may consume less power than others of the same type due to being newer models, or being energy-saving models, etc. Some climate control appliances may consume less power than others of different types. For example, a heating appliance may consume a different amount of power than an air conditioner appliance.

While embodiments are described herein in the context of these HVAC appliances, such embodiments may also apply to other types of appliances or devices that consume energy. For example, other appliances may include air purifiers, dehumidifiers, humidifiers, etc.

In various implementations, the time period may be a predetermined time range. For example, the time period may be a time range during the day (e.g., between 1:00 p.m. and 1:05 p.m., etc.). In this example, the time period is a time range during a 24-hour period. In some embodiments, the time period may be a time range that spans more than a day. For example, the time period may be a time range over a set of days (e.g., weekdays, weekend days, a week, a month, etc.) While particular climate control appliances may be rated by energy units per hour, the system may compute the energy consumption based on each time period, which may vary depending on the implementation.

At block 306, the system determines a schedule for granting the requests during the time period, where the difference between a highest aggregate energy consumption level and a lowest aggregate energy consumption level during the time period is minimized. In various embodiments, the schedule for granting the requests may be based on one or more duty cycle policies. The duty cycle policies govern the operation duty cycles of the climate control appliances. Operation duty cycles may be defined as alternating "on" cycles and "off" cycles of each of the climate control appliances. In various embodiments, the system coordinates the operation duty cycles of all of the climate control appliances in the environment to minimize peak load energy consumption of the aggregate of all of the climate control appliances. For example, operation duty cycles are constrained to minimize the "on" cycles of the climate control appliances. This results in reduced energy consumption, reduced energy costs, which helps utility companies, owners of the system, and the environment while still maintaining a comfortable climate as required by end users/building occupants such that they are not too hot, too cold, or otherwise uncomfortable in the climate-controlled environment.

Figure 4:
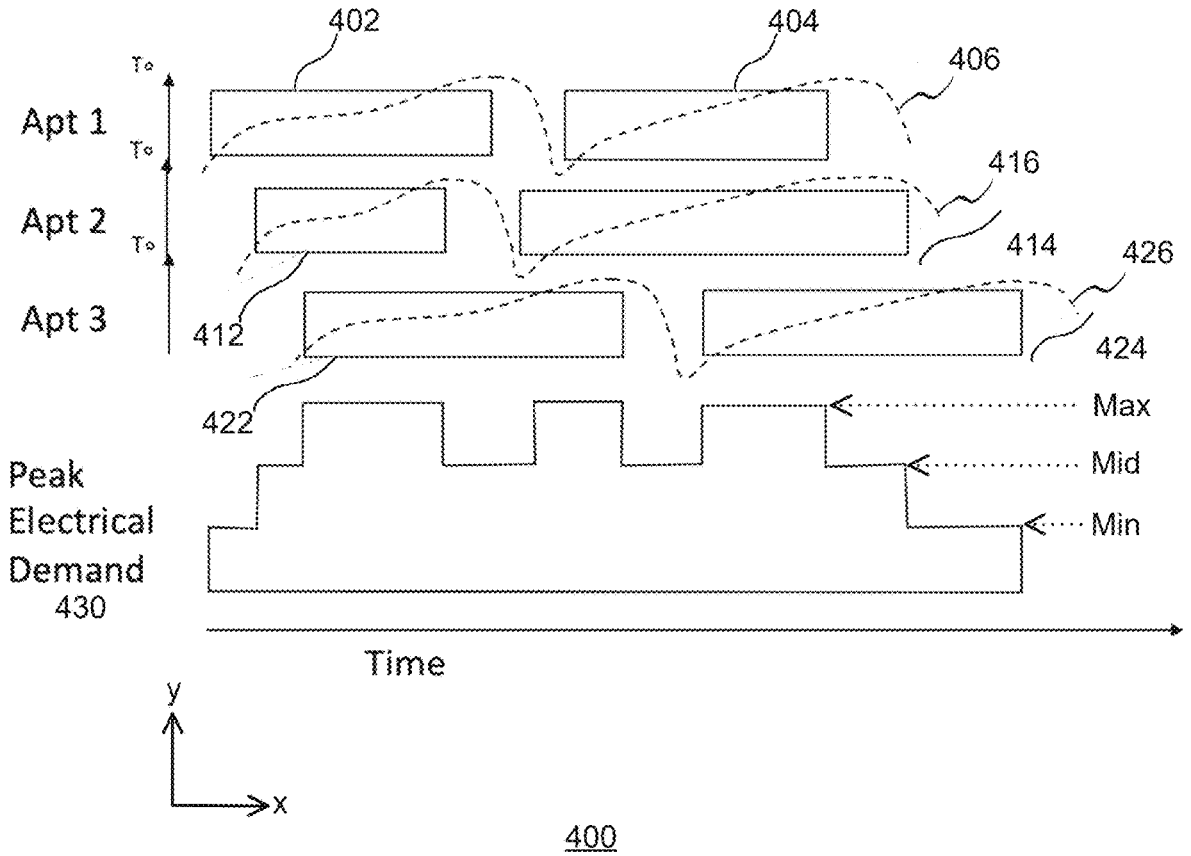
FIG. 4 is an example timing diagram showing varying consumption of energy due to varying portions of a set of climate control appliances operating at different time periods.

FIG. 4 is an example timing diagram showing varying consumption of energy due to varying portions of a set of climate control appliances operating at different time periods. Shown at the upper portion of the diagram along the y-axis are environment spaces in a predetermined environment. In this particular example implementation, the environment spaces are apartment spaces (labeled Apt 1, Apt 2, and Apt 3). These environment spaces, or "spaces," described may represent any type of space in an environment such as offices, conference rooms, manufacturing spaces, etc.

For ease of illustration, in this particular example, each space corresponds to a single climate control appliance (not shown), which may be represented by the climate control appliance of FIG. 2. Also, in this particular example, the climate control appliance is a heating appliance. The actual number of climate control appliances and the actual type or types of climate control appliance may vary, depending on the particular implementation.

The spaces Apt 1, Apt 2, and Apt 3 correspond to operation duty cycles of their corresponding climate control appliance. The operation duty cycles are shown horizontally across the x-axis. For example, space Apt 1 corresponds to "on" cycles 402 and 404, and climate pattern 406. The space Apt 2 corresponds to "on" cycles 412 and 414, and climate pattern 416. The space Apt 3 corresponds to "on" cycles 422 and 424, and climate pattern 426.

In various embodiments, these "on" cycles are represented by horizontal bars, where the left end of a given bar represents a start time of an "on" cycle, the right end of the given bar represents an end time of the "on" cycle. In various embodiments, the "end" time may also be referred to as an expiration time, where the corresponding appliance turns off. The gaps between two horizontal bars represent "off" cycles.

As indicated above, the climate control appliances in this particular example are heating appliances. With reference to space Apt1, from the start to the end of the "on" cycle 402, the temperature T° increases in degrees while the corresponding heating appliance is operating during an "on" cycle, as indicted by climate pattern 406. At the expiration of the "on" cycle 402, the temperature T° decreases in degrees, as indicted by the climate pattern 406. Accordingly, the climate patterns 406, 416, and 426 represent temperature increases and decreases in temperature T° as influenced by the operating duty cycles of their corresponding climate control appliances.

Shown at the lower portion of the diagram along the y-axis is the peak electrical demand 430. As shown, the level of the peak electrical demand 430 increases and decreases depending on the number of climate control appliances that are on a given moment in time. For example, referring to the operation duty cycles vertically above, the peak electrical demand 430 pattern steps up as the appliances enter their respective "on" cycles.

As shown, each apartment space Apt 1, Apt 2, and Apt 3 warms up as fast as the laws of physics allow as indicated by their respective climate patterns 406, 416, and 426, but in so doing the aggregate peak electrical demand can grow quite large, especially if unmanaged. For example, when one climate control appliance is on, the peak electrical demand is at a minimum. When two climate control appliances are on simultaneously, the peak electrical demand 430 is at a medium level. When three climate control appliances are on simultaneously, the peak electrical demand 430 is at a maximum level.

In various embodiments, the one or more duty cycle policies restrict a portion of the climate control appliances that are permitted to operate substantially simultaneously during the time period. More specifically, the duty cycle polices call for some climate control appliances to be on "off" cycles while one or more other climate control appliances are permitted to operate, that is, to be on "on" cycles. As described in more detail below, in connection with FIG. 5, in some implementations, a simple duty cycle policy is to have one climate control appliance on at a time.

Figure 5:
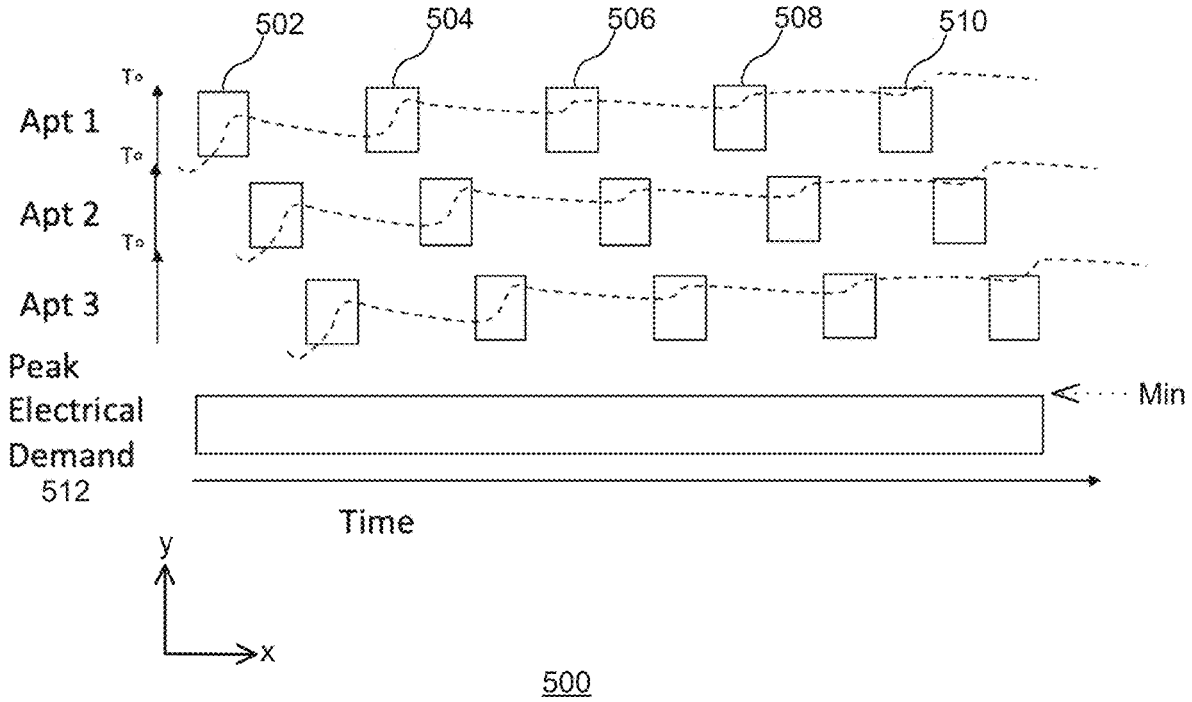
FIG. 5 is an example timing diagram for reducing peak load consumption of energy, according to some embodiments.

FIG. 5 is an example timing diagram for reducing peak load consumption of energy, according to some embodiments. The scenario in the example shown presumes the same environment spaces Apt 1, Apt 2, and Apt 3, and corresponding climate control appliances (not shown) in the predetermined environment example of FIG. 4. The difference between the example scenarios of FIGS. 4 and 5 are the duty cycles of the corresponding climate control appliances.

Referring to FIG. 5 and the duty cycle of space Apt 1, the "on" cycles 502, 504, 506, 508, and 510 are shortened and the "off" cycles are lengthened. The operation duty cycles of respective climate control appliances of respective spaces Apt 2 and Apt 3 behave similarly as those corresponding to space Apt 1. In various embodiments, the system schedules the duty cycles such that one climate control appliance operates at a given time. In other words, no two climate control appliances are in their "on" cycles simultaneously at any given time period. As a result, the system may reduce the peak electrical demand 512 by as much as two-thirds when the system schedules the operation duty cycles of the climate control appliances accordingly. In this example, by "pulsing" heat pumps of the climate control appliances on and off, it may take longer to achieve the target temperatures in the spaces Apt 1, Apt 2, and Apt 3, but the aggregate peak electrical demand 512 is dramatically reduced.

In various embodiments, the system may achieve operation duty cycle restrictions or constraints on climate control appliances by use of activation tickets. For example, when granting requests for energy consumption (e.g., to turn on particular climate control appliances), the system issues an activation ticket for each climate control appliance permitted to be turned on. In the example of FIG. 5, the operation duty cycles have "on" cycles that are uniform and pulsed. In various embodiments, the system schedules the climate control appliances to cycle on and off quickly enough such that the end user(s) do not notice the climate/temperature differences, and yet the appliances cycle sufficiently slow enough to maintain proper operation of the climate control appliances.

In various embodiments, the system may schedule the operation duty cycles such that the operation duty cycle patterns may vary from one another while keeping their respective "on" cycles staggered and not overlapping. The system schedules activation of climate control systems at appropriate start times and end times, accordingly, in order to maintain a minimum peak electrical demand 512. As shown, the difference between the maximum peak electrical demand and the minimum peak electrical demand is minimized, or zero in this case.

As indicated above, the system determines and executes a schedule for granting requests to activate or turn on climate control appliances. In various embodiments, the system uses the schedule to govern the operation duty cycles of the associated climate control appliances based on one or more duty cycle policies. In various embodiments, a duty cycle policy may be to limit the number of climate control appliances that are permitted to operate during the time period to one climate control appliance. This policy is exemplified by the scenario of FIG. 5. In other words, one climate control appliance operates at a time during the time period. Such a duty cycle policy ensures that the lowest aggregate energy consumption level during the time period is minimized, since only one climate control appliance is on at a given time (e.g., during the designated time period). This may be appropriate for a space with climate control units such as two heat pumps, for example. The algorithm as described herein ensures that one heat pump is running at a time. This is feasible because the unified smart building system has purview over all of the energy consuming equipment.

The system may be configured with parameters that characterize the electrical utilities peak demand sampling protocol so that it can alternate the activation or "on" cycles of the two climate control appliances. The duty cycle of climate control appliance activations is short enough that occupants do not sense any discomfort (e.g., not too cold, not too hot, etc.), yet is long enough to establish peak demand as 50% of what it would otherwise be if both heat pumps were running simultaneously.

In some implementations, some climate control appliances may be permitted to be on longer if the room being climate controlled is larger, or has poorer insulation, etc. A factory floor may fall into this scenario, for example. In some implementations, some climate control appliances may be permitted to be on longer if the room usage requires more human comfort. A conference room that holds many people may fall into this scenario, for example. In some embodiments, a given space in an environment might be climate controlled independently and separately from other spaces in the environment. For example, a given space such as a factory floor might require special climate control appliances due to its size. As such, the system may apply different schedules for different sets of climate control appliances in the overall environment based on user requirements and/or uses of particular spaces in the environment.

In some embodiments, a duty cycle policy may be to issue activation tickets that govern operation duty cycles such that not all climate control appliances in the predetermined environment are simultaneously operating during the predetermined moment. This allows for some flexibility in that more than one climate control appliance may still operate simultaneously and yet still achieve reduced aggregate power consumption. Such flexibility may be applied to scenarios where there may be many climate control appliances (e.g., 10, 20, etc.) in a predetermined space such as a large office building or manufacturing facility. For example, there may be a scenario in a large environment such as a factory floor or a multi-level commercial building where 20% or 50% of the climate control appliances may operate simultaneously and still save a substantial amount of energy.

In these embodiments, the highest aggregate energy consumption level might be higher than the lowest aggregate energy consumption level, because more than one climate control appliance is permitted to operate simultaneously. The system may still minimize the difference between the highest aggregate energy consumption level and the lowest aggregate energy consumption level by limiting the maximum peak electrical demand over the time period. In various embodiments, the duty cycle policies may target particular maximum peak electrical demands, which may vary, depending on the pricing schemes of the relevant utility company.

In some scenarios, a larger percentage of climate control appliances that consume less power may be permitted to operate simultaneously and still consume less power overall than the same percentage of climate control appliances that consume more power. For example, an operation policy may be that one climate control appliance is permitted to operate at a time. As such, the system may coordinate duty cycles of activation tickets such that one "on" cycle of all of the climate control appliance occurs during a given moment. A simple scenario may be where there are two climate control appliances. The "on/off" cycles of the two climate control appliances may be opposite of each other. A more complex scenario may be where there are many climate control appliances (e.g., 7, 10, 15, etc.). The "on-off" cycles of the climate control appliances may be staggered such that only one climate control appliance is on at a time.

The duty cycle policies may be consistent with the threshold policies. For example, if the threshold policy calls for one climate control appliance being on at a time, the duty cycle policy may cycle the existing climate control appliances on and off, accordingly. If the threshold policy permits multiple yet a limited portion of the climate control appliance to operate simultaneously, the duty cycle policy may call for staggered "on" cycles, accordingly. For example, in some scenarios, the "on" cycles of the climate control appliances may be staggered where two climate control appliances are permitted to operate simultaneously. As such, then those two climate control appliances cycle off, two other climate control appliances may cycle on, etc.

As indicated above, the system determines and applies a schedule for granting requests to activate or turn on climate control appliances. In various embodiments, to grant requests, the system issues an activation ticket for each request that is granted, where each activation ticket includes a start time and an expiration time that a corresponding climate control appliance is permitted to operate. The system governs the operation duty cycles by use of these activation tickets.

In various embodiments, with regard to start times, the system may schedule a particular climate control appliance to turn on at appropriate times such as when another climate control appliance is expected to cycle off based on the other climate control appliances associated expiration time. In some embodiments, a start time may be a particular clock time (e.g., 2:00 p.m., 2:10 p.m., etc.). In some embodiments, the start time may be a particular delay time (e.g., in 60 seconds, in 5 minutes, etc.). The particular structure or designation of the start time may vary, depending on the particular embodiment.

With regard expiration times, the system may schedule a particular climate control appliance to turn off at appropriate times in order to allow another climate control appliance that is not currently operating to turn on. This mechanism ensures minimum aggregate power consumption. In some embodiments, an expiration time may be a particular clock time (e.g., 2:05 p.m., 2:15 p.m., etc.) that is subsequent to the corresponding start time. In some embodiments, the start time may be particular delay times (e.g., after 60 seconds, after 5 minutes, etc.) that are subsequent to the corresponding start times. The particular structure or designation of the expiration time may vary, depending on the particular embodiment.

When a given control unit (e.g., a control unit of a space-specific HVAC control service) determines that one of its climate control appliances needs to be activated, the control unit first obtains an activation ticket from the system. After the control unit obtains an activation ticket from the system, the control unit activates/turns on the appropriate climate control appliance at the designated time and subsequently deactivates/turns off the climate control appliance at the expiration time (or sooner if the climate reaches the desired temperature). In this manner, large collections of climate control appliances, such as heat pumps, which would otherwise operate independently, can be coordinated so that peak energy demand is significantly reduced and minimized.

As indicated above, with regard to climate control systems having a significant number of climate control appliances (e.g., 10, 15, 20, etc.), the system may configure parameters and issue activation tickets such that a reduced portion (e.g., 10%, 20%, etc.) of available climate control appliances are active/in operation at any given time period. This translates into dramatic reductions in utility bills.

In some embodiments, a duty cycle policy may prioritize safety over efficiency. For example, if for some reason the system does not provide an activation ticket after an appropriate interval of time (e.g., several minutes to several hours, etc.), a given control unit may unilaterally activate a climate control appliance. This ensures that end users remain comfortable in the environment.

In some embodiments, a duty cycle policy may require requisite duty cycles, where a pause between "on/off" cycles are required. Such pauses may be used by the system to allow time to update the schedule accordingly. Such pauses may be communicated by the system to control units when such control units request activation time slots on behalf of particular climate control appliances.

Figure 6:
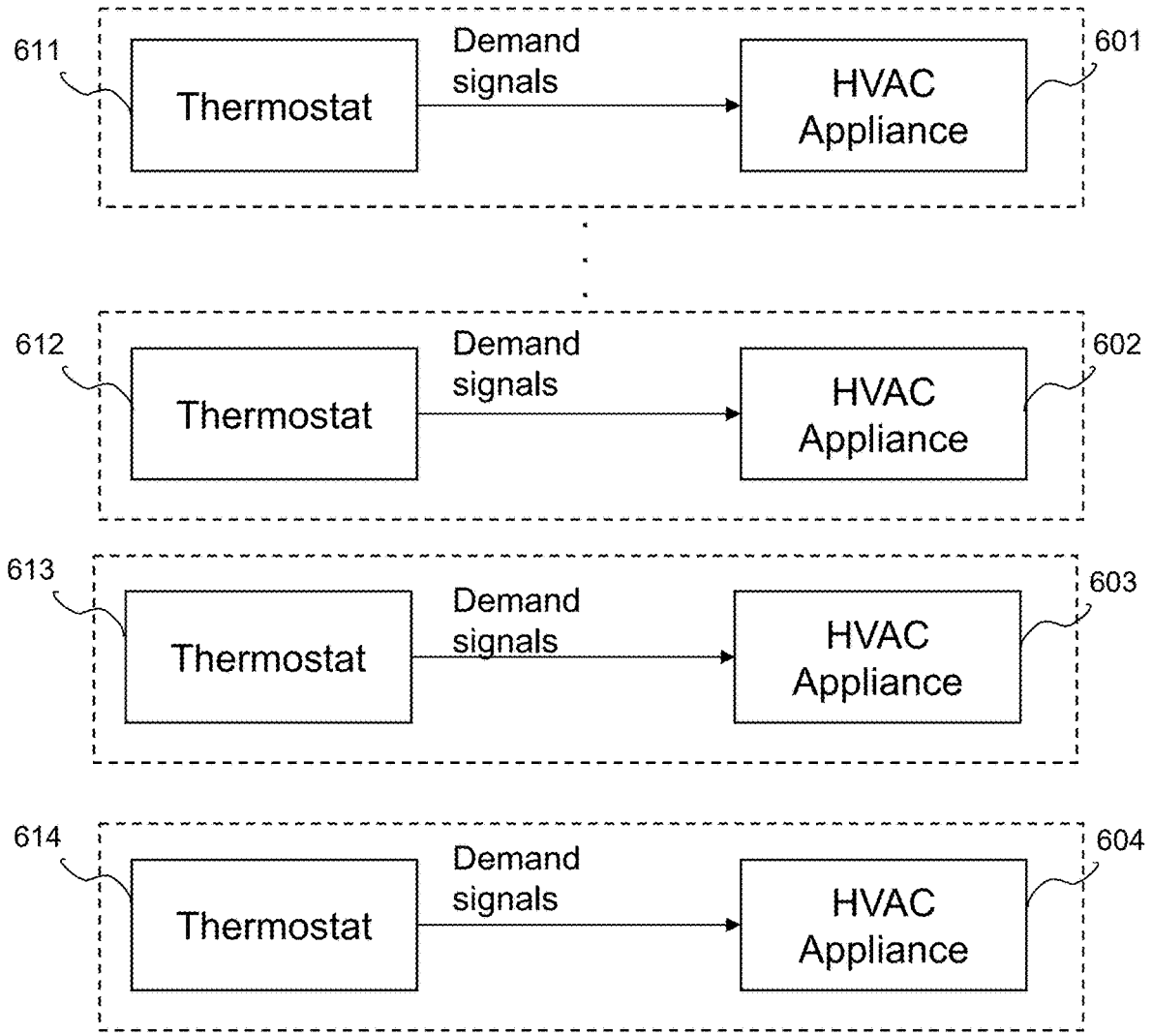
FIG. 6 illustrates example HVAC appliances as conventionally controlled.

FIG. 6 illustrates example HVAC appliances as conventionally controlled. In this example, each combination of HVAC appliance 601-604 and thermostat 611-614 operate independently of each other. For example, thermostat 611 measures the temperature of its environment and generates the heating/cooling demand signals to its corresponding HVAC appliance 601 independently of any of the other thermostats 612-614, and vice versa. The HVAC appliance 601 responds to the demand signals from its corresponding thermostat 611 by providing the heating or cooling, independently of the other HVAC appliances 602-604, and vice versa. Thus, there is no ability to systemically manage the peak load or overall energy consumption of the combination of HVAC appliances.

Figure 7:
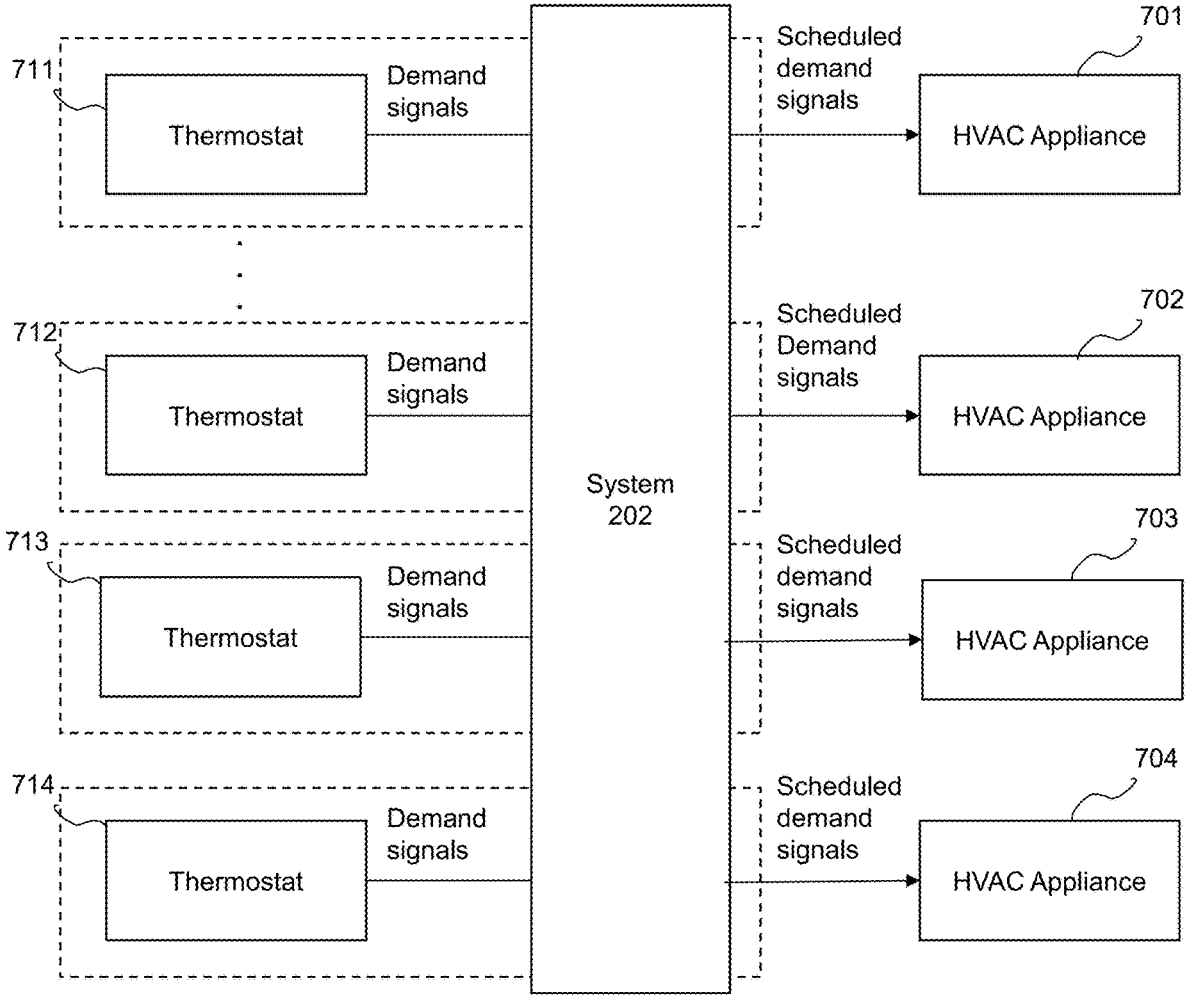
FIG. 7 illustrates example HVAC appliances as controlled by the system.

FIG. 7 illustrates example HVAC appliances as controlled by the system 202. Each combination of HVAC appliance 701-704 and thermostat 711-714 is operating on a centrally managed basis. Instead of operating independently, each thermostat 711-714 sends their demand signals to the central system 202. The system 202 then schedules the demand signals that are sent to the corresponding HVAC appliance 701-704 to minimize the peak load and overall energy consumption, while balancing occupant comfort.

Figure 8:
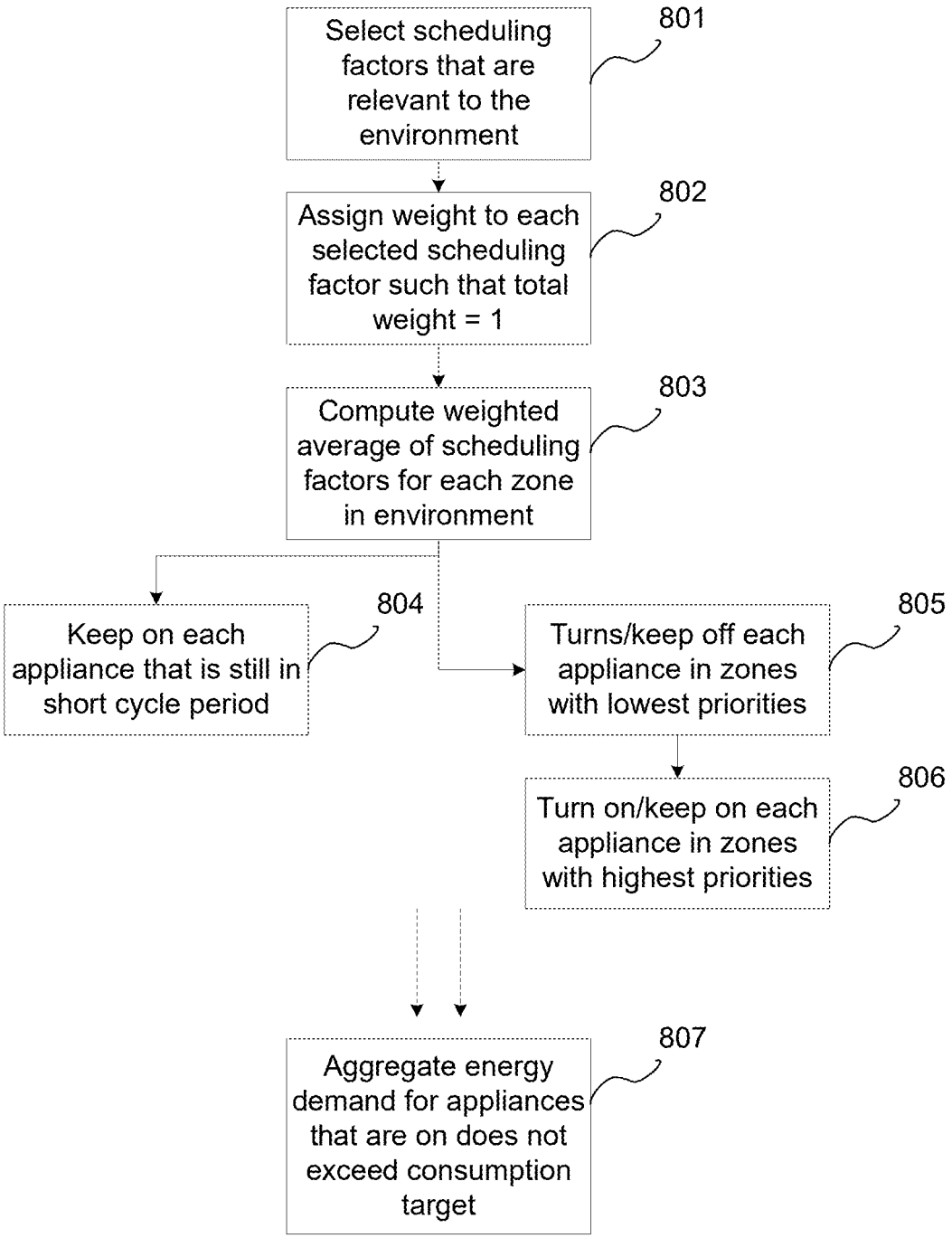
FIG. 8 is a flow diagram illustrating in more detail the scheduling of the demand signals by the system.

FIG. 8 is a flow diagram illustrating in more detail the scheduling of the demand signals by the system 202. At block 801, the system 202 selects the scheduling factors that are relevant to the environment. At block 802, the system 202 assigns a weight to each of the selected scheduling factors such that the total weight adds up to 1. At block 803, the system 202 computes the weighted average of the scheduling factors for each zone in the environment. The system 202 may be configured to compute the weighted average at a periodic rate (e.g., every 10 seconds). The system 202 then performs at least the following actions. At block 804, the system 202 keeps on each appliance that is still in its short cycle period, i.e., a cycle where the appliance turns on and off frequently. At block 805, the system 202 also turns off, or keeps off, each appliance in zones with the lowest priorities. At block 806, the system 202 also turns on, or keeps on, each appliance in zones with the highest priorities. The system 202 performs blocks 804-806 such that the aggregate energy demand for the appliances that are on does not exceed the maximum consumption target (block 807).

Any number and type of scheduling factors may be used by the system 202. Some example scheduling factors include:

For how long must an appliance be kept off before turning it on again in order to prevent "short cycling", which may damage the appliance? (When a zone has an appliance running that it still in its short cycle period, the system 202 keeps this appliance running independent of its priority.)

Is the zone from which the appliance issues a demand call currently occupied? (When zone is unoccupied, the system 202 gives this appliance lower priority.)

What is the as-built appliance-load of the zone and what is the capacity of the appliance(s) that serve the zone? (The bigger the gap between load and capacity, the longer it will take to heat up or cool down the zone. The system 202 gives zones with a large gap a higher priority.)

Do current weather conditions, such as high winds on a cold day, affect the ability to heat or cool the zone? (When a zone is affected by the present weather conditions, the system 202 gives the zone a higher priority.)

How does the physical location of the appliance affect its real-time heat/cooling load? (For example, an apartment with a western exposure might receive heat from afternoon sunlight, which can affect heating times (faster) and cooling times (slower). When a zone is affected by a transient load, the system 202 gives the zone a higher priority.)

What other HVAC-load mitigators does the zone contain (e.g., automated window shades or "smart" glass) that can also be controlled by the system 202 to reduce the real-time HVAC-load? (When a zone has mitigators that can be controlled by the system 202, the system 202 gives the zone a lower priority.)

What special requirements does an occupant have (e.g., the occupant is infirmed or require a closely controlled temperature range)? (The system 202 gives zones with special requirements a higher priority.)

What special requirements does the contents of a zone have (e.g., an assembly area factory that must be maintained in a narrow temperature band)? (The system 202 gives zones with special requirements a higher priority.)

How much energy (e.g., electricity) does the HVAC appliance that serves the zone(s) consume? (The system 202 can schedule more efficient appliances for longer on-times, as well as more frequent on-times, as compared to less efficient appliances.)

Are there any special agreements between an occupant and the landlord to allow the occupant's zone to heat slower or cool slower if the HVAC appliances were not scheduled? (The system 202 gives zones with special requirements a lower priority.)

Do energy costs vary by the calendar date or time of day? (The system 202 gives zones that consume the most energy a lower priority during intervals of high energy costs.)

Is the time to heat up or cool down a zone exceed a defined threshold? (The system 202 gives zones that exceed the threshold a higher priority.)

Based upon historical data, should a zone be primed with heating or cooling even though there is no present demand? (The system 202 gives a zone that is to be primed a higher priority.)

Although examples or embodiments above are described in the context of HVAC appliances, the systems and methods described herein may be implemented with other types of energy consuming devices with load demands without departing from the spirit and scope of the present invention. While various embodiments are described herein in the context of the stated types of high energy demand appliances, these embodiments may also apply to other types of energy consuming devices, including but not limited to manufacturing equipment, hospital equipment, and the like.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A computer-implemented method for reducing peak load consumption of energy, the method comprising:

receiving a plurality of requests for energy consumption by a corresponding plurality of climate control appliances in a predetermined environment, the predetermined environment comprising a plurality of zones:

determining an energy consumption level for each request of the plurality of requests for a time period:

selecting a plurality of scheduling factors relevant to the predetermined environment;

assigning weights to each of the plurality of scheduling factors;

computing a weighted average of the plurality of scheduling factors for each zone in the predetermined environment;

determining a schedule for granting one or more of the plurality of requests during the time period based on the weighted average for each zone, wherein a difference between a highest aggregate energy consumption level and a lowest aggregate energy consumption level during the time period is minimized; and issuing an activation ticket for each request that is granted, wherein each activation ticket comprises a start time and an expiration time that a corresponding climate control appliance is permitted to operate.

2. The method of claim 1, wherein each request of the plurality of requests is a request to operate a corresponding climate control appliance of the plurality of climate control appliances.

3. The method of claim 1, wherein the climate control appliances comprise one or more of heating, ventilation, and air conditioning (HVAC) appliances.

4. The method of claim 1, wherein the energy consumption level for each request is based on a type of climate control appliance that is associated with each request.

5. The method of claim 1, wherein the schedule for granting the plurality of requests is further based on one or more duty cycle policies, and wherein the one or more duty cycle policies restrict a portion of the plurality of climate control appliances that operate substantially simultaneously during the time period.

6. The method of claim 1, wherein the schedule for granting the plurality of requests is further based on one or more duty cycle policies, and wherein at least one of the duty cycle policies limits a number of the plurality of climate control appliances that are permitted to operate during the time period to one climate control appliance.

7. The method of claim 1, wherein each of the plurality of zones is assigned a priority, wherein determining the schedule for granting the plurality of requests during the time period comprises: determining the schedule based on a combination of the weighted average and the priority for each of the plurality of zones.

8. A non-transitory computer-readable medium comprising computer readable program code embodied therein, wherein when executed by at least one processor causes the at least one processor to perform operations comprising:

receiving a plurality of requests for energy consumption by a corresponding plurality of climate control appliances in a predetermined environment, the predetermined environment comprising a plurality of zones:

determining an energy consumption level for each request of the plurality of requests for a time period;

selecting a plurality of scheduling factors relevant to the predetermined environment;

assigning weights to each of the plurality of scheduling factors;

computing a weighted average of the plurality of scheduling factors for each zone in the predetermined environment;

determining a schedule for granting one or more of the plurality of requests during the time period based on the weighted average for each zone, wherein a difference between a highest aggregate energy consumption level and a lowest aggregate energy consumption level during the time period is minimized; and issuing an activation ticket for each request that is granted, wherein each activation ticket comprises a start time and an expiration time that a corresponding climate control appliance is permitted to operate.

9. The computer-readable medium of claim 8, wherein each request of the plurality of requests is a request to operate a corresponding climate control appliance of the plurality of climate control appliances.

10. The computer-readable medium of claim 8, wherein the climate control appliances comprise one or more of heating, ventilation, and air conditioning (HVAC) appliances.

11. The computer-readable medium of claim 8, wherein the energy consumption level for each request is based on a type of climate control appliance that is associated with each request.

12. The computer-readable medium of claim 8, wherein the schedule for granting the plurality of requests is further based on one or more duty cycle policies, and wherein the one or more duty cycle policies restrict a portion of the plurality of climate control appliances that operate substantially simultaneously during the time period.

13. The computer-readable medium of claim 8, wherein the schedule for granting the plurality of requests is further based on one or more duty cycle policies, and wherein at least one of the duty cycle policies limits a number of the plurality of climate control appliances that are permitted to operate during the time period to one climate control appliance.

14. A system comprising:

at least one processor and a computer readable storage medium having program instructions embodied therewith, the program instructions executable by the at least one processor to cause the at least one processor to perform operations comprising:

receiving a plurality of requests for energy consumption by a corresponding plurality of climate control appliances in a predetermined environment, the predetermined environment comprising a plurality of zones;

determining an energy consumption level for each request of the plurality of requests for a time period;

selecting a plurality of scheduling factors relevant to the predetermined environment;

assigning weights to each of the plurality of scheduling factors;

computing a weighted average of the plurality of scheduling factors for each zone in the predetermined environment;

determining a schedule for granting one or more of the plurality of requests during the time period based on the weighted average for each zone, wherein a difference between a highest aggregate energy consumption level and a lowest aggregate energy consumption level during the time period is minimized; and issuing an activation ticket for each request that is granted, wherein each activation ticket comprises a start time and an expiration time that a corresponding climate control appliance is permitted to operate.

15. The system of claim 14, wherein each request of the plurality of requests is a request to operate a corresponding climate control appliance of the plurality of climate control appliances.

16. The system of claim 14, wherein the climate control appliances comprise one or more of heating, ventilation, and air conditioning (HVAC) appliances.

17. The system of claim 14, wherein the energy consumption level for each request is based on a type of climate control appliance that is associated with each request.

18. The system of claim 14, wherein the schedule for granting the plurality of requests is further based on one or more duty cycle policies, and wherein the one or more duty cycle policies restrict a portion of the plurality of climate control appliances that operate substantially simultaneously during the time period.

19. The system of claim 14, wherein the schedule for granting the plurality of requests is further based on one or more duty cycle policies, and wherein at least one of the duty cycle policies limits a number of the plurality of climate control appliances that are permitted to operate during the time period to one climate control appliance.

* * * * *